US011063393B2

(12) United States Patent
Mozdzer

(10) Patent No.: US 11,063,393 B2
(45) Date of Patent: Jul. 13, 2021

(54) ELECTRICAL PLUG CONNECTOR AND WIRING DEVICE WITH KEYING FEATURES

(71) Applicant: Hubbell Incorporated, Shelton, CT (US)

(72) Inventor: Mark Anthony Mozdzer, Derby, CT (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 16/460,385

(22) Filed: Jul. 2, 2019

(65) Prior Publication Data

US 2020/0014148 A1 Jan. 9, 2020

Related U.S. Application Data

(60) Provisional application No. 62/694,659, filed on Jul. 6, 2018.

(51) Int. Cl.

| | |
|---|---|
| ***H01R 13/64*** | (2006.01) |
| ***H01R 13/645*** | (2006.01) |
| ***H01R 25/00*** | (2006.01) |
| ***H01R 13/627*** | (2006.01) |

(52) U.S. Cl.

CPC ..... *H01R 13/6456* (2013.01); *H01R 13/6273* (2013.01); *H01R 25/006* (2013.01)

(58) Field of Classification Search

CPC ..... H01R 13/6456; H01R 13/6273; H01R 25/006

USPC ..... 439/355

See application file for complete search history.

(56) References Cited

U.S. PATENT DOCUMENTS

| | | | |
|---|---|---|---|
| 1,928,638 | A | 10/1933 | Avery |
| 2,320,356 | A | 6/1943 | Frank et al. |
| 2,433,917 | A | 1/1948 | McCartney |
| 2,466,930 | A | 10/1949 | Cook |

(Continued)

FOREIGN PATENT DOCUMENTS

| | | |
|---|---|---|
| EP | 2290171 | 7/2010 |
| EP | 2637263 | 9/2013 |

(Continued)

OTHER PUBLICATIONS

International Search Report and Written Opinion mailed in PCT/US19/40322 by ISA/US dated Oct. 1, 2019.

(Continued)

*Primary Examiner* — Alexander Gilman
(74) *Attorney, Agent, or Firm* — Wissing Miller LLP

(57) ABSTRACT

The present disclosure provides exemplary embodiments of wiring device assemblies that include an electrical wiring device and electrical plug connector assembly which permits easy connection of electrical conductors to the electrical wiring device via the plug connector assembly. The wiring device assemblies are configured to operate at a common voltage rating and include keying features to ensure the electrical wiring devices are configured to mate with electrical plug connector assemblies rated for the same voltage. The keying features include a key and corresponding keyway used to prevent electrical plug connector assemblies rated for one voltage from being plugged into electrical wiring devices rated for a different voltage.

17 Claims, 5 Drawing Sheets

(56) References Cited

U.S. PATENT DOCUMENTS 2,697,149 A 12/1954 Wallace et al.
2,720,634 A 10/1955 Hart
2,790,859 A 4/1957 Tseng et al.
2,895,119 A 7/1959 Montgomery, Jr.
3,093,433 A 6/1963 Ege
3,156,761 A 11/1964 Schinske
3,192,499 A 6/1965 West
3,369,211 A 2/1968 Sundquist
3,641,472 A 2/1972 Phillips, Jr.
3,879,101 A 4/1975 McKissic
3,945,711 A 3/1976 Hohorst et al.
3,963,305 A 6/1976 Doktor et al.
3,967,195 A 6/1976 Averitt et al.
3,975,074 A 8/1976 Fuller
3,975,075 A 8/1976 Mason
3,952,244 A 10/1976 Spear
4,008,940 A 2/1977 Foley
4,015,201 A 3/1977 Chaffee
4,034,284 A 7/1977 Peplow
4,082,995 A 4/1978 Rhude
4,105,968 A 8/1978 Mobley
4,118,690 A 10/1978 Paynton
4,127,807 A 11/1978 Peplow
4,152,639 A 5/1979 Chaffee
4,203,638 A 5/1980 Tansi
4,215,328 A 7/1980 Chabot et al.
4,217,619 A 8/1980 Tibolla
4,221,458 A 9/1980 Hughes et al.
4,273,957 A 6/1981 Kolling, Jr.
4,280,092 A 7/1981 Wells, Jr. et al.
4,457,575 A 7/1984 Davis et al.
4,470,077 A * 9/1984 Komine ..... G11B 31/006
348/335
4,477,141 A 10/1984 Hardesty
4,485,282 A 11/1984 Lee
4,544,219 A 10/1985 Barkas
4,563,054 A 1/1986 Wilmes
4,713,023 A 12/1987 Bixler et al.
4,725,249 A 2/1988 Blackwood et al.
4,764,129 A 8/1988 Jones
4,781,623 A 11/1988 Philippson et al.
4,842,551 A 6/1989 Heimann
4,865,556 A 9/1989 Campbell et al.
4,924,561 A 5/1990 Yoneyama
4,992,055 A 2/1991 Brummans et al.
5,006,075 A 4/1991 Bowden, Jr.
5,015,203 A 5/1991 Furrow
5,069,630 A 12/1991 Tseng et al.
5,113,045 A 5/1992 Crofton
5,117,122 A 5/1992 Hogarth
5,146,385 A 9/1992 Misencik
5,147,215 A 9/1992 Pritulsky
5,178,555 A 1/1993 Kilpatrick et al.
5,224,009 A 6/1993 Misencik
5,238,428 A 8/1993 Brakenridge et al.
5,266,039 A 11/1993 Boyer et al.
5,281,154 A 1/1994 Comerci et al.
5,285,163 A 2/1994 Liotta
5,297,973 A 3/1994 Gorman
5,370,556 A 12/1994 Olsson
5,382,177 A 1/1995 Hutchinson, Jr. et al.
5,454,730 A 10/1995 Tozuka
5,456,373 A 10/1995 Ford
5,472,350 A 12/1995 Mehta
5,486,117 A * 1/1996 Chang ..... H01R 13/6275
439/353
5,494,456 A 2/1996 Kozel et al.
5,546,657 A 8/1996 Mehta et al.
5,582,522 A 12/1996 Johnson
5,625,285 A 4/1997 Virgilio
5,642,052 A 6/1997 Earle
5,654,857 A 8/1997 Gershen
5,679,021 A 10/1997 Kramer
5,735,700 A 4/1998 Hohorst
5,785,551 A 7/1998 Libby
5,816,867 A 10/1998 Davidsz et al.
D400,501 S 11/1998 Flachslaeder et al.
5,839,908 A 11/1998 Bonilla et al.
5,876,243 A 3/1999 Sangawa
5,964,618 A 10/1999 McCarthy
5,975,925 A 11/1999 Tiberio, Jr.
5,975,938 A 11/1999 Libby
5,975,940 A 11/1999 Hartmann et al.
6,028,268 A 2/2000 Stark et al.
6,045,374 A 4/2000 Candeloro
6,054,849 A 4/2000 Collier
6,072,317 A 6/2000 Mackenzie
6,132,238 A 10/2000 Hartmann et al.
6,146,187 A 11/2000 Pallai
6,146,217 A 11/2000 Osada
6,155,890 A 12/2000 Gerberding
6,156,971 A 12/2000 May
6,218,844 B1 4/2001 Wong
6,285,534 B1 9/2001 Gibson et al.
6,309,248 B1 10/2001 King
6,323,652 B1 11/2001 Collier
6,341,981 B1 1/2002 Gorman
6,350,162 B1 2/2002 Despang
6,376,770 B1 4/2002 Hyde
6,377,427 B1 4/2002 Haun et al.
6,457,988 B1 10/2002 Anderson
6,464,545 B2 10/2002 Yano
6,494,728 B1 12/2002 Gorman
6,563,049 B2 5/2003 May
6,589,076 B1 7/2003 Davis et al.
6,634,898 B2 10/2003 Clements
6,657,144 B2 12/2003 Savicki, Jr. et al.
6,682,364 B2 1/2004 Cisey
6,692,284 B1 2/2004 Koh
6,719,581 B2 4/2004 Kikuchi
6,737,582 B2 5/2004 Van Lieu et al.
6,746,286 B2 6/2004 Blaha
6,753,471 B2 6/2004 Johnson
6,767,245 B2 7/2004 King
6,773,313 B2 8/2004 Pedrinelli et al.
6,774,307 B2 8/2004 Kruse et al.
6,814,608 B2 11/2004 Kollmann
6,814,611 B1 11/2004 Torres
6,832,938 B2 12/2004 Lenker
6,843,680 B2 1/2005 Gorman
6,870,099 B1 3/2005 Schultz et al.
6,908,330 B2 * 6/2005 Garrett ..... H01R 13/518
439/378
6,911,602 B2 6/2005 Conrad
6,924,719 B2 8/2005 Saruwatari et al.
6,939,179 B1 9/2005 Kieffer, Jr. et al.
6,981,890 B2 1/2006 Cutler et al.
6,982,558 B2 1/2006 Bryndzia
6,994,585 B2 2/2006 Benoit et al.
7,052,313 B2 5/2006 Gorman
7,057,401 B2 6/2006 Blades
7,068,038 B2 6/2006 Mason
7,083,463 B2 8/2006 Steinkemper et al.
7,091,723 B2 8/2006 Simmons
7,114,982 B2 10/2006 Shimizu et al.
7,115,001 B1 10/2006 Brockman et al.
7,131,857 B2 11/2006 Mueller
7,140,887 B2 11/2006 Poh et al.
7,179,137 B1 2/2007 Quendt et al.
7,189,099 B2 3/2007 Whyne et al.
7,189,110 B1 3/2007 Savicki, Jr.
7,195,517 B1 3/2007 Savicki, Jr.
7,199,587 B2 4/2007 Hurwicz
7,238,043 B2 7/2007 Reibke et al.
7,241,188 B2 7/2007 Lin et al.
7,248,056 B2 7/2007 Waldschmidt
7,249,963 B2 7/2007 Ramm
7,259,567 B2 8/2007 Sears
7,265,291 B1 9/2007 Gorman
7,281,942 B2 10/2007 Swedberg et al.
7,285,009 B1 10/2007 Benoit et al.
7,289,306 B2 10/2007 Huang
7,326,091 B2 * 2/2008 Nania ..... H01R 13/6271
439/681

(56) References Cited

U.S. PATENT DOCUMENTS

| | | | | |
|---|---|---|---|---|
| 7,367,121 | B1 | 5/2008 | Gorman | |
| 7,384,319 | B2 | 6/2008 | Kirstein et al. | |
| 7,385,406 | B1 | 6/2008 | Blades | |
| 7,402,075 | B1 | 7/2008 | Probst | |
| 7,407,410 | B1 | 8/2008 | Benoit et al. | |
| 7,411,766 | B1 | 8/2008 | Huang et al. | |
| 7,438,587 | B2 | 10/2008 | Germani | |
| 7,470,145 | B1 | 12/2008 | Savicki, Jr. et al. | |
| 7,497,725 | B2 | 3/2009 | Savicki, Jr. et al. | |
| 7,501,926 | B2 | 3/2009 | Watchorn et al. | |
| 7,510,429 | B1 | 3/2009 | Savicki, Jr. et al. | |
| 7,527,509 | B1 | 5/2009 | Bethurum et al. | |
| 7,528,609 | B2 | 5/2009 | Savicki, Jr. et al. | |
| 7,575,464 | B2 | 8/2009 | Kobayashi et al. | |
| 7,628,640 | B2 | 12/2009 | Radle | |
| 7,645,158 | B2 | 1/2010 | Mulhouse et al. | |
| 7,651,363 | B2 | 1/2010 | Koellmann | |
| 7,690,952 | B2 | 4/2010 | Koellmann et al. | |
| 7,722,389 | B2 | 5/2010 | Benoit et al. | |
| 7,736,174 | B2 | 6/2010 | Bhosale et al. | |
| 7,736,175 | B1 | 6/2010 | Savicki, Jr. et al. | |
| 7,744,427 | B2 * | 6/2010 | Zhang | H01R 13/64 439/638 |
| 7,749,018 | B1 | 7/2010 | Benoit et al. | |
| 7,754,967 | B2 | 7/2010 | Kruse et al. | |
| 7,762,838 | B2 | 7/2010 | Gorman | |
| 7,780,470 | B2 | 8/2010 | Benoit | |
| 7,794,268 | B2 | 9/2010 | Breen, IV et al. | |
| 7,815,463 | B2 | 10/2010 | Gerberding | |
| 7,833,038 | B1 | 11/2010 | King, Jr. et al. | |
| 7,845,970 | B2 | 12/2010 | Stromiedel | |
| 7,896,686 | B2 | 3/2011 | Hoppe | |
| 7,963,812 | B2 | 6/2011 | Ilkhanov | |
| 7,976,330 | B2 | 7/2011 | Lin | |
| 8,096,818 | B2 | 1/2012 | Arenas et al. | |
| 8,235,748 | B2 | 8/2012 | Lacey et al. | |
| 8,342,886 | B2 * | 1/2013 | Zhang | H01R 12/7005 439/660 |
| 8,344,250 | B2 | 1/2013 | Padro | |
| 8,466,367 | B2 | 6/2013 | Reibke | |
| 8,529,280 | B2 * | 9/2013 | Lim | H01R 12/73 439/345 |
| 8,540,527 | B2 * | 9/2013 | Puluc | H01R 13/64 439/271 |
| 8,613,624 | B2 | 12/2013 | Arenas et al. | |
| 8,694,709 | B2 * | 4/2014 | Loffink | H01R 13/70 361/679.33 |
| 8,771,008 | B1 | 7/2014 | Black et al. | |
| 9,009,258 | B2 | 4/2015 | Ramachandran et al. | |
| 9,130,285 | B2 | 9/2015 | Scanzillo et al. | |
| 9,537,235 | B2 * | 1/2017 | Tsang | H01R 12/7005 |
| 9,543,711 | B2 * | 1/2017 | Nakayama | H01M 2/1077 |
| 9,806,437 | B2 * | 10/2017 | Scanzillo | H01R 4/4818 |
| 10,122,123 | B1 * | 11/2018 | Tsfasman | H01R 13/6485 |
| 10,446,990 | B2 * | 10/2019 | Dykas | H01R 13/7038 |
| 2002/0052139 | A1 | 5/2002 | German | |
| 2002/0055301 | A1 | 5/2002 | Gorman | |
| 2002/0236010 | | 12/2003 | Gorman | |
| 2005/0075008 | A1 | 4/2005 | Spink, Jr. | |
| 2006/0103390 | A1 | 5/2006 | Simmons et al. | |
| 2007/0211397 | A1 | 9/2007 | Sokolow et al. | |
| 2008/0131055 | A1 * | 6/2008 | Parkman | G02B 6/3825 385/58 |
| 2008/0268679 | A1 | 10/2008 | Tiberio et al. | |
| 2009/0130878 | A1 * | 5/2009 | Xu | H01R 13/621 439/157 |
| 2009/0186500 | A1 | 7/2009 | Benoit et al. | |
| 2009/0197461 | A1 | 8/2009 | Benoit et al. | |
| 2010/0105238 | A1 | 4/2010 | Good | |
| 2010/0105249 | A1 * | 4/2010 | Bandhu | H01R 13/6271 439/638 |
| 2010/0227484 | A1 | 9/2010 | Arenas et al. | |
| 2011/0028045 | A1 * | 2/2011 | Zhu | H01R 13/4361 439/660 |
| 2011/0195605 | A1 * | 8/2011 | Zhang | H01R 27/02 439/638 |
| 2013/0072046 | A1 | 3/2013 | Bazayev et al. | |
| 2013/0244468 | A1 * | 9/2013 | Chang | H01R 13/6395 439/345 |
| 2014/0170877 | A1 | 6/2014 | Scanzillo et al. | |
| 2014/0170908 | A1 * | 6/2014 | Scanzillo | H01R 24/76 439/682 |
| 2015/0044900 | A1 * | 2/2015 | Mcdowall | H01R 13/6395 439/372 |
| 2015/0194763 | A1 * | 7/2015 | Gagne | H01R 13/62 439/159 |
| 2015/0357758 | A1 * | 12/2015 | Krietzman | H01R 13/639 439/345 |
| 2015/0364866 | A1 * | 12/2015 | Gagne | H01R 13/635 439/159 |
| 2016/0365671 | A1 * | 12/2016 | Stevens | H01R 13/621 |
| 2017/0093148 | A1 * | 3/2017 | Wang | H01R 13/717 |
| 2018/0083402 | A1 * | 3/2018 | Higashiura | H01R 33/94 |
| 2018/0198235 | A1 * | 7/2018 | Huang | H01R 13/652 |
| 2018/0366871 | A1 * | 12/2018 | Huang | H01R 4/4863 |

FOREIGN PATENT DOCUMENTS

| | | |
|---|---|---|
| GB | 2224890 | 5/1990 |
| WO | 2004095647 | 11/2004 |
| WO | 2006083920 | 8/2006 |

OTHER PUBLICATIONS

SNAPConnect(TM) Get Connected in a Snap with Hubbell (brochure); www.hubbell-wiring.com; Apr. 2007; 4 pgs.

Leviton Manufacturing Co., Inc. lev-lok(Tm) Modular Receptacles (brochure); www.leviton.com/industrial; 2008; 5 pgs.

Leviton Manufacturing Co., Inc; The Wire Simplifier lev-lok(R) brochure; www.leviton/com/industrial; 2009; 2 pgs.

Cooper Industries. LTD; ArrowLink(TM) Modular Wiring Devices; Cooper Wiring Devices (brochure); www.cooperwiringdevices.com; 2009; 28 pgs.

Richter et al, Practical Electrical Wiring, 1993, 16th Edition, McGraw-Hill, US; pp. 137-139, 176-177 and 507-510.

Bryant Wiring Device Catalog BDB-1506, May 1994, pp. C12, D12, D16, F2 and F5.

Leviton Wiring Device Catalog, D-200, 1978, Little Neck, NY, pp. C1, T9 and T12.

Pass & Seymour Plug Tail Wiring Devices Brochure; Apr. 2004.

First Alert; User's Manual for Smoke and Firm Alarms, Jul. 2004; Mexico, pp. 1-6.

Early et al, NEC 1999 National Electrical Code Handbook, NFPA, 8th ed. (1999) pp. v-vii, 2, 69-70 and 98.

BRK Electronics, User's Manual—Smoke Alarms, Jun. 2000.

T. Engdahl, Telephone Ringing Circuits, 1997, www.tkk.fi/misc/electronics/circuits/telephone_ringer.html.

P & S Plug Tail Installation—Speed Comparison Video, Pass & Seymour website (www.passandseymour.com/plugtail/video.cfm, Jun. 2007.

BRK Electronics (First Alert), Model SC6120B—User's Manual for AC Powered Smoke and Carbon Monoxide Alarm with Battery Back-up and Silence Feature, 2001.

NEC 2005 Handbook, 2005, Article 314-317, Conductors Entering Boxes, Conduit Bodies, or Fittings, National Fire Protection Association, Inc. p. 327.

UL Standard 514A, Metallic Outlet Boxes, Underwrites Laboratories Inc, Tenth Edition, 2004, p. 39.

International Search Report and Written Opinion mailed in PCT/US19/40322 dated Oct. 1, 2019 (10 pages).

* cited by examiner

Fig. 5
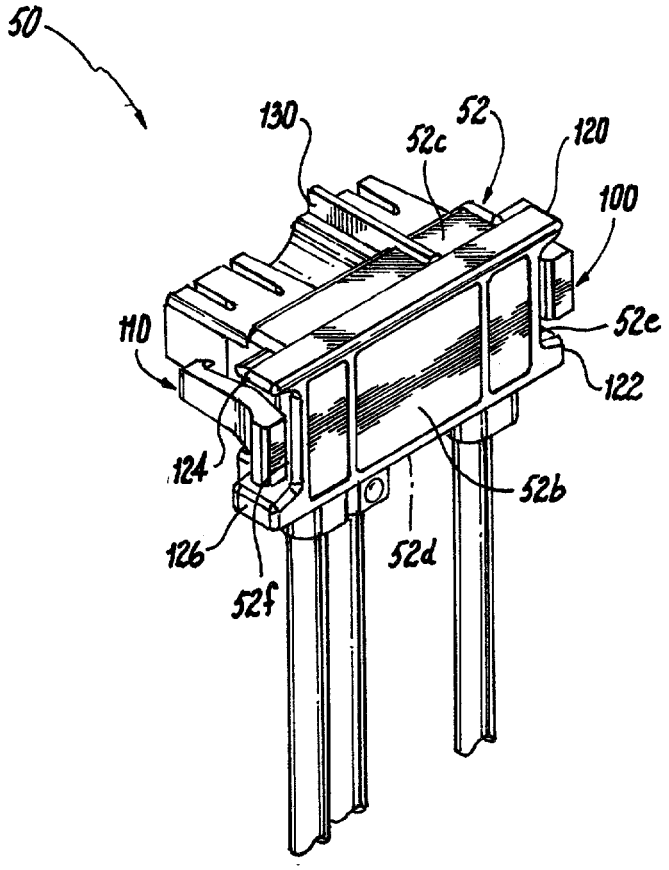
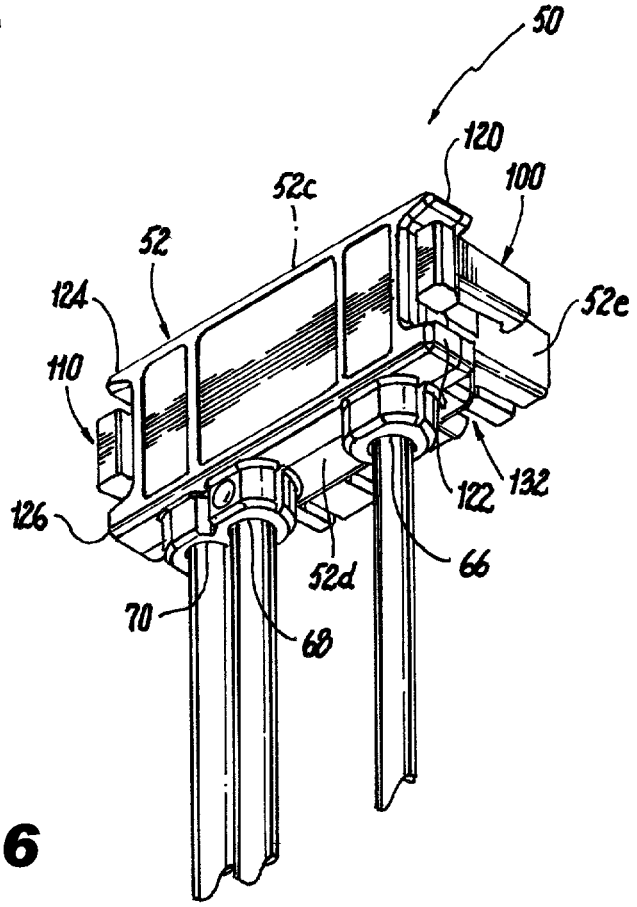
Fig. 6

ELECTRICAL PLUG CONNECTOR AND WIRING DEVICE WITH KEYING FEATURES

CROSS REFERENCE TO RELATED APPLICATIONS

The present disclosure is based on and claims benefit from U.S. Provisional Patent Application Ser. No. 62/694,659 filed on Jul. 6, 2018 entitled "Electrical Plug Connector and Wiring Device with Keying Features" the contents of which are incorporated herein in their entirety by reference.

BACKGROUND

Field

The present disclosure relates to electrical wiring devices and electrical plug connector assemblies providing easy connection of electrical conductors to the electrical wiring devices. More particularly, the present disclosure relates to electrical wiring devices and electrical plug connector assemblies rated for one voltage with keying features to prevent electrical plug connector assemblies from being plugged into electrical wiring devices that are not rated for the same voltage.

Description of the Related Art

To facilitate connecting electrical wires to an electrical wiring device, such as an electrical receptacle, some electrical wiring devices have an aperture in their rear face for receiving an electrical plug connector terminating a plurality of wires. The wires terminated by the electrical plug connector are connected to the existing power wires in a known manner. Thus, once the plug connector assemblies are wired, an electrician is not required to connect the electrical plug connector to the electrical wiring device.

When connecting an electrical plug connector to the electrical wiring device, precautions are desired to reduce the possibility that an electrical plug connector rated for one voltage, e.g., 250 volts, is not inadvertently installed in an electrical wiring device rated for a different voltage, e.g., 120 volts.

SUMMARY

The present disclosure provides exemplary embodiments of wiring device assemblies that include an electrical wiring device and electrical plug connector assembly that permit easy connection of electrical conductors to the electrical wiring device via the electrical plug connector assembly. The wiring device assemblies according to the present disclosure include keying features, such as keys and keyways, to prevent electrical plug connector assemblies rated for one voltage from being plugged into electrical wiring devices that are rated for a different voltage.

In an exemplary embodiment, the electrical plug connector assembly includes a connector housing, at least one key and at least one keyway. The connector housing has a body portion and a plug portion. The plug portion is configured to fit within an aperture in a rear face of a body of the electrical device. The at least one key is disposed on the plug portion of the connector housing and is configured to interact or mate with at least one keyway associated with the aperture of the electrical device. The at least one keyway is disposed in the plug portion of the connector housing and is configured to interact or mate with at least one key in the aperture of the electrical device. In an exemplary embodiment, the at least one key on the plug portion of the connector housing is a rib extending from the plug portion of the connector housing, and the at least one keyway in the plug portion of the connector housing is a groove in the plug portion of the connector housing.

An exemplary embodiment of an electrical device assembly includes electrical wiring device and a plug connector assembly. The electrical wiring device has a body with an aperture in a rear face of the body. The plug connector assembly is configured to mate with the aperture in the rear face of the body of the electrical device. The plug connector assembly includes a connector housing, at least one key and at least one keyway. The connector housing has a body portion and a plug portion that is configured to fit within the aperture in the rear face of the body. The at least one key is disposed on the plug portion of the connector housing and is configured to interact or mate with at least one keyway in the rear face of the body and associated with the aperture. The at least one keyway is disposed in the plug portion of the connector housing and is configured to interact or mate with at least one key in the aperture of the electrical device. In an exemplary embodiment, the at least one key on the plug portion of the connector housing is a rib extending from the plug portion of the connector housing, and the at least one keyway in the rear face of the body is a groove that can receive the rib. The at least one keyway in the plug portion of the connector housing is a groove in the plug portion of the connector housing, and the at least one key in the aperture of the electrical device is a rib that is received in the groove.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein:

FIG. 5 is a rear perspective view of the plug connector assembly of FIG. 4;

FIG. 6 is another rear perspective view of the plug connector assembly of FIG. 4;

DETAILED DESCRIPTION

Figure 1:
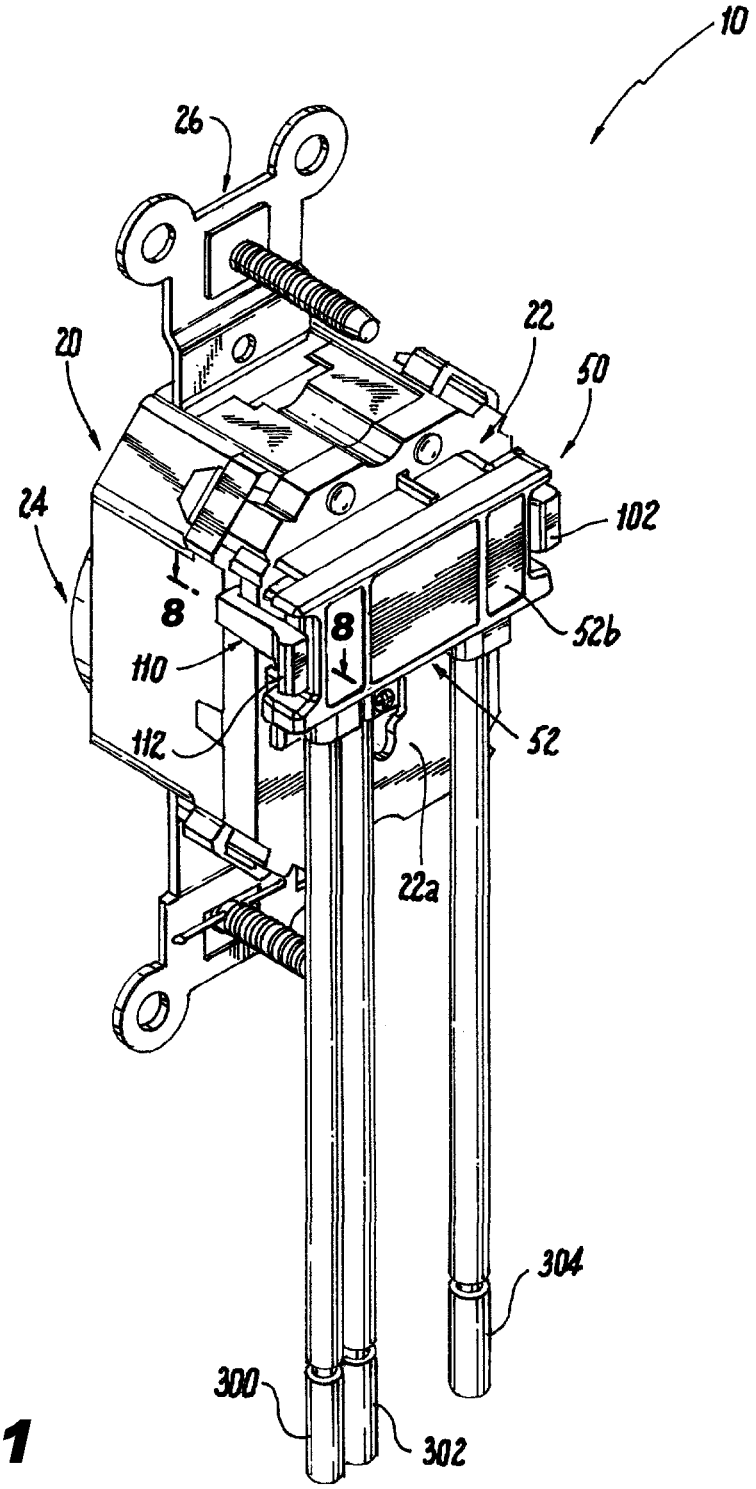
FIG. 1 is a rear perspective view of an exemplary embodiment of a wiring device assembly according to the present disclosure, illustrating a plug connector assembly connected to an electrical wiring device.

The present disclosure provides exemplary embodiments of wiring device assemblies that include an electrical wiring device and electrical plug connector assembly that provide easy connection of electrical conductors to the electrical wiring device. The wiring device assemblies according to the present disclosure are configured to operate at a common voltage rating and include keying features to ensure the electrical wiring devices are configured to mate with electrical plug connector assemblies rated for the same voltage. For example, the electrical wiring device may be rated for 250 volts and the keying features are provided so that electrical plug connector assemblies rated for 250 volts can mate with the electrical wiring device. Thus, for example, the keying features can be used to prevent electrical plug connector assemblies rated for 250 volts from being plugged into electrical wiring devices rated for 120 volts.

As used in the present disclosure, the terms "front," "rear," "upper," "lower," "upwardly," "downwardly," and other orientational descriptors are intended to facilitate the description of the electrical wiring devices and the electrical plug connector assemblies, and are not intended to limit the structure of the electrical wiring devices and the electrical plug connector assemblies to any particular position or orientation. For ease of description, the wiring device assemblies may be referred to herein as the "device assembly" in the singular and the "device assemblies" in the plural. Similarly, the electrical wiring devices according to the present disclosure may be referred to as the "device" in the singular and the "devices" in the plural. The electrical wiring devices contemplated include any type of electrical wiring device suitable for insertion into an electrical box. Non-limiting examples of electrical wiring devices contemplated by the present disclosure include single receptacles, duplex receptacles, single pole switches, multi-pole switches, etc. The electrical plug connector assemblies according to the present disclosure may be referred to as the "connector assembly" in the singular and the "connector assemblies" in the plural.

Referring to FIGS. 1-4, an exemplary embodiment of a device assembly 10 is shown. In the exemplary embodiment shown, the device assembly 10 includes a device 20 and a connector assembly 50. The device 20 includes a body or housing 22, a front cover 24 and a yoke 26 used to secure the device 20 to an electrical box as is known. The body 22 has a rear surface 22*a* that includes an aperture 28 providing access to components within the body 22. Within the aperture 28 are one or more contact members 30, 32 and 34, which are also known as blades or prongs. The one or more contact members 30, 32 and 34 supply electrical power to the device 20 as is known. The body 22 has a first overhang 36 and a second overhang 38 that interact with latch members 104 and 114, seen in FIG. 7, on the connector assembly 50 to releasably connect or secure the connector assembly 50 to the device 20 as described below. The body 22 and the aperture 28 also include keying features that interact with keying features on the connector assembly 50 to ensure that connector assemblies rated for one voltage are mated with devices rated for the same voltage. The keying features are described in more detail below.

Referring now to FIGS. 2 and 4-7, an exemplary embodiment of a connector assembly 50 according to the present disclosure is shown. The connector assembly 50 includes a connector housing 52, which for reference purposes is divided into a body portion 54 and a plug portion 56, seen in FIG. 2. The plug portion 56 of the connector housing 52 is configured to fit within the aperture 28 in the device 20. The connector housing 52 is preferably unitarily or monolithically formed as a one-piece member. However, the connector housing 52 may be made of individual components, e.g., the body portion 54 and the plug portion 56, or an upper half and a lower half, that are secured together by welds, e.g., sonic welds, adhesives, mechanical fasteners, snap-fit connections or other known methods.

Figure 2:
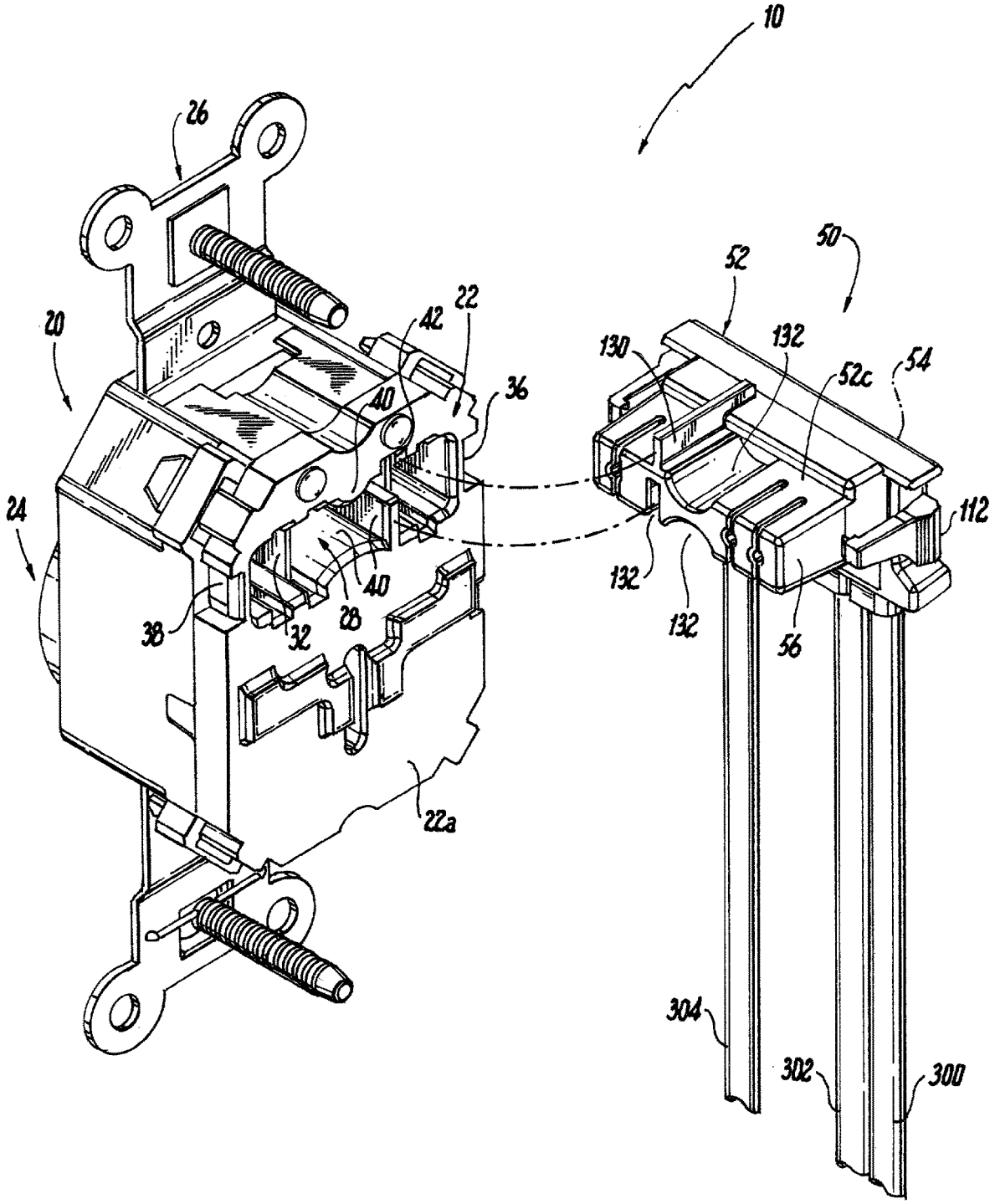
FIG. 2 is a rear perspective view of the wiring device assembly of FIG. 1, illustrating the plug connector assembly disconnected from the electrical wiring device.
Figure 3:
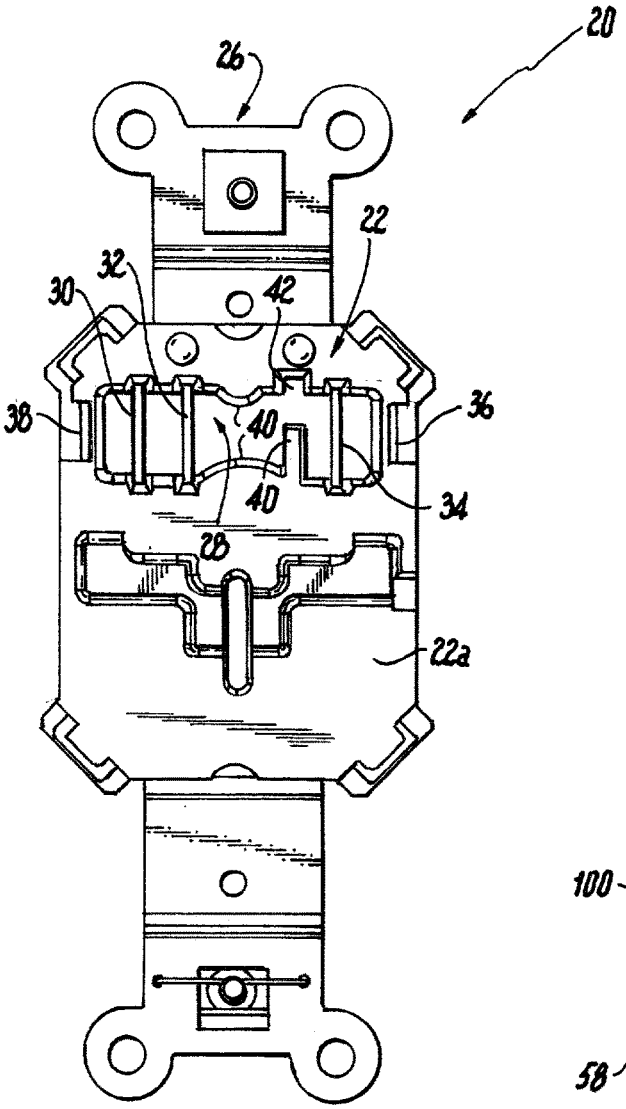
FIG. 3 is a rear elevation view of the electrical wiring device of FIG. 1, illustrating keying features within an aperture of the electrical wiring device.
Figure 4:
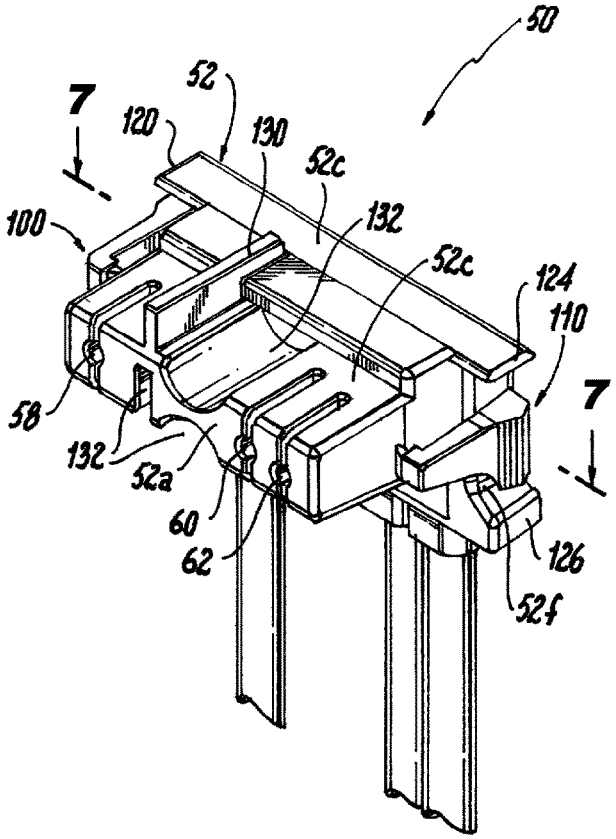
FIG. 4 is a front perspective view of an exemplary embodiment of the plug connector assembly of FIG. 1, illustrating keying features on a plug portion of the plug connector assembly.
Figure 7:
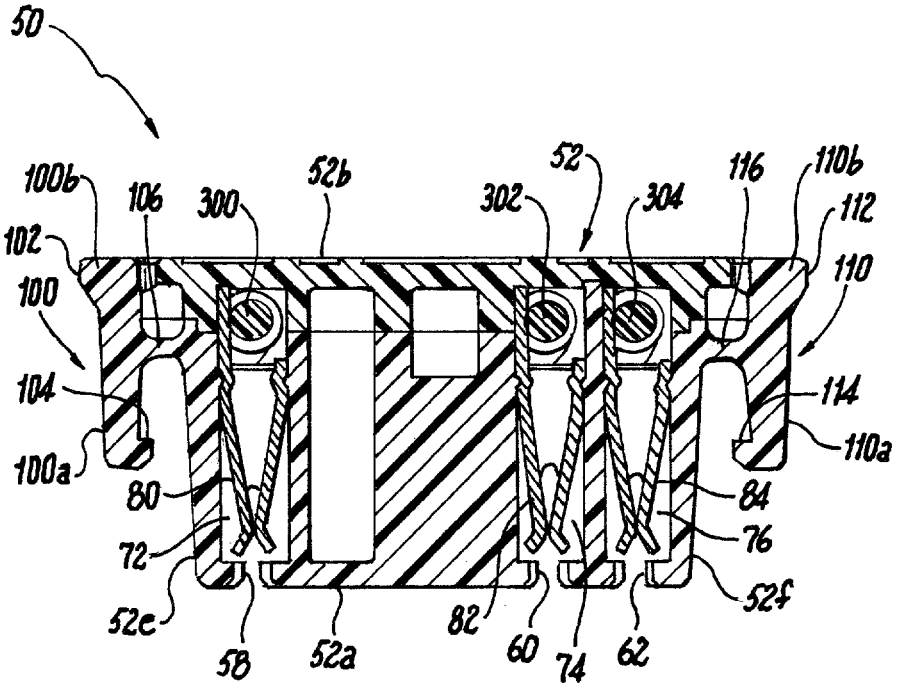
FIG. 7 is a cross-sectional view of the plug connector assembly of FIG. 4 taken from line 7-7.

Referring to FIGS. 1, 2, and 4-6, the connector housing 52 has a front surface 52*a*, a rear surface 52*b* disposed opposite the front surface 52*a*, an upper surface 52*c*, a bottom surface 52*d* disposed opposite the upper surface 52*c*, and first and second side surfaces 52*e* and 52*f* that extend between the upper surface 52*c* and the bottom surface 52*d*. The front surface 52*a* of the connector housing 52 includes a plurality of slots 58, 60 and 62, as seen in FIGS. 4 and 7. The bottom surface 52*d* of the connector housing 52 includes one or more wire openings 66, 68, and 70, seen in FIG. 6, that permit electrical wires, e.g., wires 300, 302 and 304, to enter the interior of the housing 52 as described below. In the embodiment shown, there are three wire openings, 66, 68 and 70. However, any suitable number of wires may be used with the connector assembly 50 as required by the device 20 with which the connector assembly 50 is to be mated. Wires, e.g., wires 300, 302 and 304, seen in FIG. 2, are connectable to the building wiring, e.g., hot, neutral and ground wires, within an electrical box to which the device assembly 10 is to be mounted as is known. Each slot 58, 60 and 62 in the front surface 52*a* of the connector housing 52 corresponds to a wire opening in the bottom surface 52*d* of the connector housing, and a passageway is formed between the slot and the wire opening. For example, in the embodiment shown in FIGS. 6 and 7, slot 58 corresponds to wire opening 66 and passageway 72 is formed between the slot 58 and the wire opening 66. Slot 60 corresponds to wire opening 68 and passageway 74 is formed between the slot 60 and the wire opening 68. Similarly, slot 62 corresponds to wire opening 70 and passageway 76 is formed between the slot 62 and the wire opening 70. First, second and third contact members 80, 82 and 84 are disposed in the first, second and third passageways 72, 74 and 76, respectively. The contact members 80, 82 and 84 are connected to the wires 300, 302 and 304 respectively, and are configured to connect to or contact the contact members 34, 32 and 30, seen in FIG. 3, when the connector assembly 50 is connected to the device 20.

As noted, the connector assembly 50 is configured to be connected to a device 20 to supply electrical power to the device. In some instances, it may be desirable to latch the connector assembly 50 to the device 20 so that the connector assembly 50 does not inadvertently or accidentally disconnect from the device 20. Referring to FIGS. 2, 4, 7 and 8, to latch the connector assembly 50 to the device 20, the connector housing 52 may include one or more latch assemblies. For example, in the exemplary embodiment shown, the connector housing 52 includes two latch assemblies, namely a first latch assembly and a second latch assembly.

Continuing to refer to FIGS. 2, and 4-8, the first latch assembly includes a first latching arm 100 and a first latch member 104. The first latch assembly may also include a first deflecting member 102. The first latching arm 100 extends substantially parallel to the first side surface 52*e* of the connector housing 52. The first latching arm 100 is movable, e.g., pivotable or deflectable, relative to the body 22 of the device 20 to facilitate connecting the connector housing 52 to and disconnecting the connector housing from the device 20. In the exemplary embodiment shown, the first latching arm 100 includes the first latch member 104 and the first deflecting member 102. The first latch member 104 extends inwardly from a forward end 100*a* of the first latching arm 100, as seen in FIG. 7. The first latch member 104 is configured to engage the first overhang 36, seen in FIG. 2, in the body 22 of the device 20, similar to that seen in FIG. 8, to releasably connect the connector assembly 50 to the device 20. The first deflecting member 102 is disposed at a rearward end 100*b* of the first latching arm 100, as seen in FIG. 7, and is used to move, e.g., pivot, the first latching arm 100 when disconnecting the connector housing 50 from the device 20, as described below. A first connecting arm 106 connects the first latching arm 100 to the first side surface 52*e* of the connector housing 52, as seen in FIG. 7, at a point between the forward end 100*a* and the rearward end 100*b* of the first latching arm 100. The first connecting arm 106 preferably extends substantially perpendicularly to the first side surface 52*e* of the connector housing 52. The first connecting arm 106 allows the first latching arm 100 to move, e.g., flex, rotate or pivot, about the connecting arm 106 so that the first latch member 104 can engage with or disengage from the first overhang 36 of the body 22 of the device 20, similar to that seen in FIG. 8.

Figure 8:
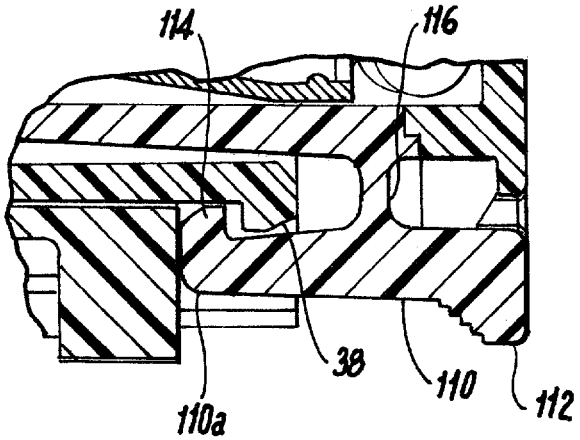
FIG. 8 is an enlarged view of a portion of the wiring device assembly of FIG. 1 taken in cross section from line 8-8 to illustrate the latching of the plug connector assembly connected to the electrical wiring device.

Continuing to refer to FIGS. 2, and 4-8, the second latch assembly includes a second latching arm 110 and a second latch member 114. The second latch assembly may also include a second deflecting member 112. The second latching arm 110 extends substantially parallel to the second side surface 52*f* of the connector housing 52. The second latching arm 110 is movable, e.g., pivotable or deflectable, relative to the body 22 of the device 20 to facilitate connecting the connector housing 52 to and disconnecting the connector housing from the device 20. In the exemplary embodiment shown, the second latching arm 110 includes the second latch member 114 and the second deflecting member 112. The second latch member 114 extends inwardly from a forward end 110*a* of the second latching arm 110, as seen in FIG. 7. The second latch member 114 is configured to engage the second overhang 38 in the body 22 of the device 20, as seen in FIG. 8, to facilitate releasably connecting the connector assembly 50 to the device 20. The second deflecting member 112 is disposed at a rearward end 100*b* of the second latching arm 110, as seen in FIG. 7, and is used to move, e.g., pivot, the second latching arm 110 when disconnecting the connector housing 50 from the device 20, as described below. A second connecting arm 116 connects the second latching arm 110 to the second side surface 52*f* of the connector housing 52, seen in FIG. 7, at a point between the forward end 110*a* and the rearward end 110*b* of the second latching arm 110. The second connecting arm 116 preferably extends substantially perpendicularly to the second side surface 52*f* of the connector housing 52. The second connecting arm 116 allows the second latching arm 110 to move, e.g., flex, rotate or pivot, about the connecting arm 116 so that the second latch member 114 can engage with or disengage from the second overhang 38 of the body 22 of the device 20, as seen in FIG. 8.

The connector housing 52 also includes a first set of barriers 120 and a second set of barriers 122 provided to limit and possibly prevent wires 300 and 302 and other objects from accidentally or inadvertently causing the latching arms 100 and 110 from disconnecting from their respective overhang 36 or 38. In the exemplary embodiment shown in FIGS. 5-7, the first set of barriers includes first and second barriers 120 and 122, seen in FIG. 6. The first and second barriers 120 and 122 extend outwardly from the first side surface 52*e* of the connector housing 52 and along the first side surface 52*e* so as to shield the first deflecting member 102 to limit and possibly prevent wires 300 and 302 and other objects from inadvertently or accidentally causing the first latching arm 100 to disconnect from the first overhang 36 of the body 22 of the device 20. The second set of barriers includes third and fourth barriers 124 and 126, seen in FIGS. 5 and 6. The third and fourth barriers 124 and 126 extend outwardly from the second side surface 52*f* of the connector housing 52 and along the second side surface 52*f* so as to shield the second deflecting member 112 to limit and possibly prevent wires 300 and 302 and other objects from inadvertently or accidentally causing the second latching arm 110 to disconnect from the second overhang 38 of the body 22 of the device 20.

As noted above, the present disclosure provides exemplary embodiments of wiring device assemblies that include keying features to ensure the devices 20 connect to connector assemblies 50 rated for the same voltage. The keying features include a key 40, seen in FIG. 2, and corresponding keyway 42 used to prevent electrical plug connector assemblies rated for one voltage from being plugged into electrical wiring devices rated for a different voltage. In the exemplary embodiment shown in FIGS. 2-4, the device 20 includes one or more device keys 40 and one or more device keyways 42, and the connector housing 52 includes one or more connector keys 130 and one or more connector keyways 132.

In the exemplary embodiment shown in FIGS. 2 and 3, the device keys 40 are ribs extending into the aperture 28 in the body 22 of the device 20. However, the device key 40 may be any structure sufficient to block entry of an incompatible connector assembly 50 into the aperture 28 of a device 20. In the exemplary embodiment shown, the device keyways 42 are grooves, notches or channels in the body 22 of the device 20 which are associated with, adjacent to or part of the aperture 28. However, the device keyways 42 may be any structure sufficient to receive a key of a compatible connector assembly 50 into the device 20. The device key 40 may be aligned with the device keyway 42 as shown in FIG. 3. However, the device key 40 may be positioned relative to the aperture 28 at any location on the aperture 28, which may differ from the location of the device keyway 42. In the exemplary embodiment shown in FIGS. 2 and 4, the connector keys 130 are ribs extending from the plug portion 56 of the connector housing 52. However, the connector keys 130 may be any structure sufficient to block entry of a connector assembly 50 into an incompatible device 20. The connector keys 130 can extend from the upper surface 52*c*, the bottom surface 52*d* or one of the side surfaces 52*e* and 52*f* of the connector housing 52. In the embodiment shown, the connector keys 130 extend from the upper surface 52*c*. The connector keyways 132 are grooves, notches or channels in the plug portion 56 of the connector housing 52 that are accessible from the front surface 52*a* of the connector housing 52. However, the connector keyways 132 may be any structure sufficient to receive a key from a compatible device 20. The connector key 130 may be aligned with the connector keyway 132 as shown in FIG. 4. However, the connector key 130 may be positioned relative to the front surface 52*a* of the connector housing 52 at any location, which may differ from the location of the connector keyway 132.

In operation, to connect the connector assembly 50 to the device 20, the plug portion 56 of the connector housing 52 is inserted into the aperture 28 of the body 22 of the device 20. When the plug portion 56 is inserted into the aperture 28, if the connector assembly 50 is compatible with the device 20, the device key 40 is received in the connector keyway 132 and the connector key 130 is received in the device keyway 42.

If the connector assembly 50 is incompatible with the device 20, the device key 40 and the connector key 130 block entry of the connector assembly 50 into the aperture 28 of the device 20. If the connector assembly 50 is compatible with the device 20, when the plug portion 56 of the connector housing 52 is inserted into the aperture 28, the contact members 30, 32 and 34 of the device 20 slide into respective slots 62, 60 and 58 in the connector housing 52 so that the contact members 30, 32 and 34 engage corresponding contact members 84, 82 and 80 within the connector housing 52. In addition, as the plug portion 56 is inserted into the aperture 28, the first latching arm 100 flexes so that the first latch member 104 slides past the first overhang 36 in the body 22 of the device 20 and engages the first overhang 36. Similarly, as the plug portion 56 is inserted into the aperture 28, the second latching arm 110 flexes so that the second latch member 114 slides past the second overhang 38 in the body 22 of the device 20 and engages the second overhang 38, as seen in FIG. 8. As a result, the first and second latching arms 100 and 110 releasably secure the connector assembly 50 to the device 20. To remove the connector assembly 50 from the device 20, the first and second deflecting members 102 and 112 are deflected inwardly against the biasing of the integral hinges provided by the connecting arms 106 and 116 such that the first and second latch members 104 and 114 move, e.g., pivot, outwardly to disengage first and second latch members 104 and 114 from the respective overhangs 36 and 38 allowing the connector assembly 50 to be withdrawn from the aperture 28 of the device 20.

When the connector assembly 50 is connected to the device 20, the electrical contact members 84, 82 and 80 within the connector housing 52 are in electrical contact with contact members 30, 32 and 34 within the device 20 so that electrical power is transmitted through the connector assembly 50 to the device 20 to supply power to a load. For example, in instances where the device 20 is a receptacle, electrical power would be transmitted through the connector assembly 50 to the receptacle 20 to supply power to a load plugged into the receptacle 20.

It will be understood that various modifications can be made to the embodiments of the present disclosure without departing from the spirit and scope thereof. Therefore, the above description should not be construed as limiting the disclosure, but merely as embodiments thereof. Those skilled in the art will envision other modifications within the scope and spirit of the invention as defined by the claims appended hereto.

What is claimed is:

1. An electrical plug connector assembly for mating with an electrical wiring device, the plug connector assembly comprising:

a connector housing having a body portion and a plug portion, wherein the body portion includes at least one wire opening and at least one electrical wire within the at least one wire opening, and wherein the plug portion is configured to fit within an aperture in a rear face of a body of the electrical wiring device and includes at least one electrical contact member disposed within at least one passageway of the plug portion, the at least one passageway being in communication with the at least one wire opening such that the at least one wire is electrically connected to the at least one electrical contact;

at least one key the plug portion of the connector housing configured to mate with at least one keyway associated with the aperture of the electrical wiring device; and at least one keyway in the plug portion of the connector housing configured to mate with at least one key the aperture of the electrical wiring device;

wherein the respective keys and keyways being aligned in one axis.

2. The plug connector assembly according to claim 1, wherein the at least one key on the plug portion of the connector housing comprises a rib extending from the plug portion of the connector housing.

3. The plug connector assembly according to claim 1, wherein the at least one keyway in the plug portion of the connector housing comprises a groove in the plug portion of the connector housing.

4. The plug connector assembly according to claim 1, further comprising at least one latch assembly used to releasably latch the connector housing to the electrical wiring device.

5. The plug connector assembly according to claim 4, wherein the at least one latch assembly comprises:

a latching arm operatively coupled to the connector housing; and a latch member extending from a first end of the latching arm and configured to engage the electrical wiring device.

6. The plug connector assembly according to claim 5, wherein the at least one latch assembly further comprises a deflecting member positioned adjacent a second end of the latching arm.

7. An electrical device assembly comprising:

an electrical wiring device having a body with an aperture in a rear face of the body; and a plug connector assembly for mating with the aperture in the rear face of the body of the electrical wiring device, the plug connector assembly comprising:

a connector housing having a body portion and a plug portion, wherein the body portion includes at least one wire opening and at least one electrical wire within the at least one wire opening, and wherein the plug portion is configured to fit within the aperture in the rear face of the body of the electrical wiring device and includes at least one electrical contact member disposed within at least one passageway of the plug portion, the at least one passageway being in communication with the at least one wire opening such that the at least one wire is electrically connected to the at least one electrical contact;

at least one key the plug portion of the connector housing configured to interact with at least one keyway in the rear face of the body and associated with the aperture; and at least one keyway the plug portion of the connector housing configured to interact with at least one key in the aperture of the electrical wiring device;

wherein the respective keys and keyways being aligned in one axis.

8. The electrical device assembly according to claim 7, wherein the at least one key on the plug portion of the connector housing comprises a rib extending from the plug portion of the connector housing, and the at least one keyway in the rear face of the body comprises a groove that can receive the rib.

9. The electrical device assembly according to claim 7, wherein the at least one keyway in the plug portion of the connector housing comprises a groove in the plug portion of the connector housing, and the at least one key in the aperture of the electrical wiring device comprises a rib, wherein the groove can receive the rib.

10. The electrical device assembly according to claim 7, wherein the plug connector assembly further comprises at least one latch assembly used to releasably latch the connector housing to the electrical wiring device.

11. The electrical device assembly according to claim 10, wherein the at least one latch assembly comprises:

a latching arm operatively coupled to the connector housing; and a latch member extending from a first end of the latching arm and configured to engage the electrical wiring device.

12. The electrical device assembly according to claim 11, wherein the at least one latch assembly further comprises a deflecting member positioned adjacent a second end of the latching arm.

13. An electrical device assembly comprising:

an electrical wiring device having a body with an aperture in a rear face of the body; and a plug connector assembly comprising:

a connector housing having a body portion and a plug portion, wherein the body portion includes at least one wire opening and at least one electrical wire within the at least one wire opening, and wherein the plug portion is configured to fit within the aperture in the rear face of the body of the electrical wiring device and includes at least one electrical contact member disposed within at least one passageway of the plug portion, the at least one passageway being in communication with the at least one wire opening such that the at least one wire is electrically connected to the at least one electrical contact;

at least one key the plug portion of the connector housing configured to interact with at least one keyway in the rear face of the body and associated with the aperture;

at least one keyway the plug portion of the connector housing configured to interact with at least one key in the aperture of the electrical wiring device; and at least one latch assembly used to releasably latch the connector housing to the electrical wiring device;

wherein the respective keys and keyways being aligned in one axis.

14. The electrical device assembly according to claim 13, wherein the at least one key on the plug portion of the connector housing comprises a rib extending from the plug portion of the connector housing, and the at least one keyway in the rear face of the body comprises a groove that can receive the rib.

15. The electrical device assembly according to claim 13, wherein the at least one keyway in the plug portion of the connector housing comprises a groove in the plug portion of the connector housing, and the at least one key in the aperture of the electrical wiring device comprises a rib, wherein the groove can receive the rib.

16. The electrical device assembly according to claim 13, wherein the at least one latch assembly comprises:

a latching arm operatively coupled to the connector housing; and a latch member extending from a first end of the latching arm and configured to engage the electrical wiring device.

17. The electrical device assembly according to claim 16, wherein the at least one latch assembly further comprises a deflecting member positioned adjacent a second end of the latching arm.

* * * * *